US010275968B2

(12) United States Patent
Troesch et al.

(10) Patent No.: US 10,275,968 B2
(45) Date of Patent: Apr. 30, 2019

(54) METHOD FOR PROVIDING A VISITOR CONTROLLED ACCESS INTO A BUILDING

(71) Applicant: Inventio AG, Hergiswil (CH)

(72) Inventors: Florian Troesch, Zurich (CH); Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 15/532,180

(22) PCT Filed: Dec. 2, 2015

(86) PCT No.: PCT/EP2015/078269

§ 371 (c)(1),
(2) Date: Jun. 1, 2017

(87) PCT Pub. No.: WO2016/087478

PCT Pub. Date: Jun. 9, 2016

(65) Prior Publication Data

US 2017/0270732 A1 Sep. 21, 2017

(30) Foreign Application Priority Data

Dec. 2, 2014 (EP) ..... 14195825

(51) Int. Cl.
*G07C 9/00* (2006.01)

(52) U.S. Cl.
CPC ..... *G07C 9/00904* (2013.01); *G07C 9/00103* (2013.01); *G07C 9/00166* (2013.01); *G07C 9/00896* (2013.01); *G07C 2009/00769* (2013.01)

(58) Field of Classification Search
CPC ..... G07C 9/00904; G07C 9/00103; G07C 2009/00769
USPC ..... 340/5.61
See application file for complete search history.

(56) References Cited

U.S. PATENT DOCUMENTS 6,754,484 B1 6/2004 Hiltunen et al.
6,847,823 B2 1/2005 Lehikoinen et al.
8,396,485 B2 3/2013 Grainger et al.
(Continued)

FOREIGN PATENT DOCUMENTS

WO 20016/136662 A1 12/2006
WO 2007/031654 A1 3/2007
(Continued)

*Primary Examiner* — Hirdepal Singh
(74) *Attorney, Agent, or Firm* — Baker & Hostetler, LLP

(57) ABSTRACT

The present invention proposes a method for providing a visitor controlled access into a building. Initially, entrance identification information is provided to a mobile device of the visitor when the mobile device is in close proximity of an entrance of the building. The mobile device then sends the entrance identification information to a remote server. In response the server sends hack a list of residents of the building to the mobile device based on the entrance identification information, and the mobile device presents the list of residents to the visitor. The visitor then selects a resident from the list, and subsequently a link is established between the mobile device and a remote device associated with the selected resident. Finally, access grant information is provided to an access control means adapted to control access of the visitor into the building via the entrance.

17 Claims, 1 Drawing Sheet

(56) References Cited

U.S. PATENT DOCUMENTS

| | | | | |
|---|---|---|---|---|
| 2012/0278901 | A1* | 11/2012 | Bunter | G07C 9/00103 726/28 |
| 2014/0049364 | A1* | 2/2014 | Ahearn | G07C 9/00571 340/5.51 |
| 2014/0266585 | A1* | 9/2014 | Chao | G07C 9/00111 340/5.61 |
| 2014/0313010 | A1* | 10/2014 | Huang | G07C 9/00309 340/5.61 |
| 2015/0199859 | A1* | 7/2015 | Ouyang | G07C 9/00111 340/5.61 |
| 2015/0199863 | A1* | 7/2015 | Scoggins | G07C 9/00904 340/5.25 |
| 2015/0312531 | A1* | 10/2015 | Samad | H04N 7/186 348/143 |
| 2016/0049030 | A1* | 2/2016 | G | G07C 9/00571 340/5.61 |
| 2016/0078699 | A1* | 3/2016 | Kalb | G07C 9/00571 340/5.6 |

FOREIGN PATENT DOCUMENTS

| | | | | |
|---|---|---|---|---|
| WO | WO 2007031654 | A1 * | 3/2007 | G07C 9/00111 |
| WO | 2014/066342 | A1 | 5/2014 | |
| WO | 2014/066429 | A1 | 5/2014 | |

* cited by examiner

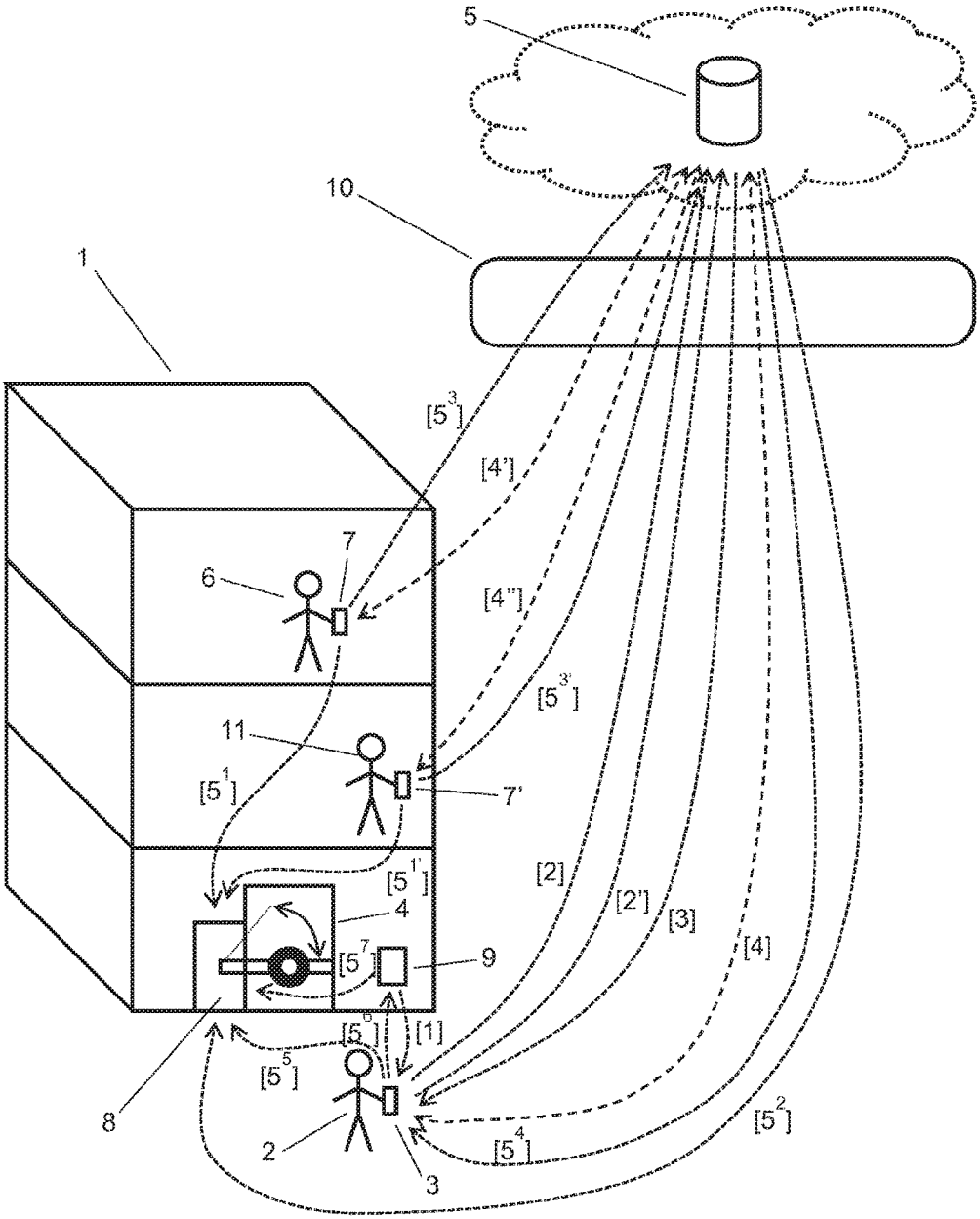
5
10
1
[5^3]
[4']
7
6
[4'']
[5^3']
11
[5^1]
7'
[5^1']
[2]
[2']
[3]
[4]
4
[5^7]
9
[5^6]
[1]
[5^5]
8
2
[5^4]
3
[5^2]

METHOD FOR PROVIDING A VISITOR CONTROLLED ACCESS INTO A BUILDING

CROSS-REFERENCE TO RELATED APPLICATIONS

This application is the national phase application under 35 U.S.C. § 371 claiming the benefit of priority based on International Patent Application No. PCT/EP2015/078269, filed on Dec. 2, 2015, which claims the benefit of priority based on European Patent Application No. 14195825.6, filed on Dec. 2, 2014. The contents of each of these applications are herein incorporated by reference.

FIELD OF THE INVENTION

The present invention is related to a method for providing a visitor controlled access into a building.

BACKGROUND OF THE INVENTION

Access to buildings such as office buildings and apartment buildings is often restricted and the entrance doors are locked so that visitors cannot enter the building without having received permission or authorisation to do so from a resident of the building. In order to request access the visitor will usually ring the door bell of the resident he wishes to visit. For this purpose fixtures, such as nameplates are located next to an entrance of the building along with associated bell buttons, allowing the visitor to determine who is a resident of the building and to alert the resident that there is a visitor waiting at the entrance. The alerted resident will then typically establish contact with the visitor by means of an intercom system installed within the building. Once the resident has established the identity of the visitor, he may provide access into the building by unlocking the entrance door. Usually, the resident is able to remotely unlock the entrance door via the intercom system. A disadvantage of the presently required fixtures (e.g. nameplates, bell buttons and intercom system) is the high cost involved with their installation and maintenance. Moreover, they usually require dedicated wiring within the building and impose certain restrictions on the layout of the building (since considerable space is needed at the entrance especially for large buildings with many residents). Furthermore, nameplates have to be maintained up-to-date when residents change. Hence, there is a need for an improved means for providing visitors controlled access into buildings.

SUMMARY OF THE INVENTION

It is an object of the present invention to provide an alternative method for providing a visitor controlled access into a building. It is especially an aim of the present invention to provide a method that overcomes the above stated disadvantages of present solutions. It is a further goal of the present invention to allow simple and rapid deployment of means for providing visitors controlled access to buildings.

The object stated above is achieved by a method for providing a visitor controlled access into a building, comprising the steps of:

providing entrance identification information to a mobile device of the visitor when the mobile device is in close proximity f an entrance of the building, the entrance identification information being uniquely associated with the entrance, in particular with a location of the entrance;

the mobile device sending the entrance identification information to a remote server; the server sending a list of residents of the building to the mobile device based on the entrance identification information;

the mobile device receiving the list of residents of the building from the server;

the mobile device presenting the list of residents to the visitor;

the visitor selecting a resident from the list of residents;

the mobile de-ice receiving an input from the visitor regarding a selection of a resident from the list of residents, i.e. regarding a selected resident;

establishing a link between the mobile device and a remote device associated with the selected resident, and communicating via said link; and providing access grant information to an access control means adapted to control access of the visitor into the building via the entrance.

A resident (or occupant) is a person who works or lives in the building and who can provide, e.g. grant, a visitor access into the building, i.e. has authorisation and appropriate means to do so. On the other hand, a visitor is a person wishing to gain access into the building and requires permission to do so, e.g. from a resident or a third party, such as a representative, having authorisation and appropriate means to grant visitors access into the building. The mobile device is regarded to be in close proximity of the entrance for instance when it is located within a distance of 20 m, in particular of 5 m, more particularly of 2 m, from the entrance.

With the proposed solution there is no need for nameplates and bell buttons at the entrance of the building, nor is there a need to install an intercom system in the building so that a resident can communicate from his office or apartment with a visitor located at the entrance. The proposed solution is therefore (essentially) "fixtureless". The only infrastructure that needs to be provided at the entrance is an access control means for selectively allowing the visitor to pass into the building through the entrance, e.g. by automatically unlocking or releasing a door, a gate or a mechanical or optical turnstile. Additionally, means may have to be installed that provide the entrance identification as will be described below. Such a solution can therefore be deployed more rapidly and flexibly and at less cost than with the presently employed fixtures noted above. Moreover, since the list of residents is provided from a server, i.e. from a central source, the information provided to the user can be maintained up-to-date easily and economically. Moreover, the list may provide additional information, such as the present availability of a resident (e.g. a "do not disturb" notice), the new address of a prior resident or a (welcome) message from a resident to potential visitors for instance when the resident is (temporarily) absent.

In an embodiment of the method providing the entrance identification information comprises at least one of the following:

the entrance identification information being transmitted by a wireless short range communication device located at or in close proximity of the entrance, in particular a beacon, such as a Bluetooth low energy (BLE) beacon, an infrared beacon or a radio frequency identifier (MD) tag;

the entrance identification information being transmitted by a near-field communication (NFC) device located at or in close proximity of the entrance;

the entrance identification information being transmitted via a wireless local area network (WLAN) or a wireless peer-to-peer network, such as WiFi Direct, located at or in close proximity of the entrance;

providing position information of the mobile device, such as geographic location or relative location, derived from a positioning system, such as GPS, GLONASS or Galileo, or derived from information provided by mobile/cellular (3G/4G) and/or WLAN signals, such as achieved by means of Skyhook's hybrid-positioning technology;

the entrance identification information being transmitted by an acoustic beacon; the entrance identification information being provided by a visual code, such as an alphanumeric string, a barcode, a matrix barcode (e.g. a QR code) or a colour code, arranged/presented/displayed at or in close proximity of the entrance.

In a further embodiment of the method providing the entrance identification information further comprises at least one of the following:

taking a picture with a camera of the mobile device (3);

picking up sound with a microphone of the mobile device (3);

entering text and/or numbers into the mobile device (3), for instance by means of finger gestures/movements on a touch sensitive screen or by means of speech recognition;

bringing the mobile device (3) into contact with or immediate proximity of the near-field communication device.

In a certain embodiment the entrance can be identified with the aid of the mobile device of the visitor itself, e.g. based on position information determined by the mobile device by means of a positioning/localisation system. Alternatively, the entrance and especially its surroundings may be sufficiently distinct to allow identification of the entrance based on a photo taken with a camera of the mobile device. In both cases no special infrastructure needs to be provided at the entrance in order to be able to identify the entrance. On the other hand, simple means can be deployed at or close to the entrance in order to be able to uniquely identify the entrance, e.g. based on a special, characteristic visual/optical, acoustical or radio frequency (RF) signal. The cost for such entrance identification Means and for their installation is lower than that of present fixtures, especially when comprising a large number of nameplates. Furthermore, very little space is required for installing them. Moreover, since the information regarding the building's residents is not directly provided by the entrance identification means, their complexity and functionality can be very minimal, thus resulting in low cost. On the other hand the complexity of the system is allocated to the visitor's mobile device, which can also be used for other tasks, and the server, which can be employed to handle a large number of building, both of which offsets or compensates their associated cost.

In a further embodiment of the method the entrance identification information and/or the access grant information is time-dependent, in particular a validity of the entrance identification information and/or the access grant information is time-limited. By making this information time-dependent it can for instance be ascertained that the visitor's mobile device is in fact using current entrance identification and/or access grant information, and not stored information which is outdated. This in turn ensures that the visitor is actually present at the entrance in order to receive and/or send up-to-date information, and not located elsewhere and trying to trick the system with stored information retrieved in the past.

In a further embodiment the method further comprises sending information related to the visitor to the server. Such information can comprise a personal user profile of the visitor. This information may for instance be used to (validly) identify the visitor and then to provide the visitor with customised or personalised information, e.g. an annotated list of residents, a list with "favourites", a ranked list, a list with "tips", or a list compiled in a certain style or in a language.

In a further embodiment of the method the access grant information is automatically provided based on data associated with the visitor, such as information regarding an appointment, a schedule, a task or a function of the visitor, in particular is automatically provided by the remote device or the server. Furthermore, the access grant information can be automatically provided based on data associated with the selected resident, e.g. information regarding an appointment, a schedule, a task or a function of the selected resident, and in particular is automatically provided by the remote device or the server. In this way it is possible that the selected resident's device automatically grants the visitor access into the building if the visitor for instance has a scheduled appointment with the selected resident (e.g. a patient going to a physician) or when the visitor has come to perform a specific task at a certain time (e.g. a delivery service bringing a package or a pizza). Moreover, selected visitors, e.g. friends or relatives of the selected resident or emergency services (e.g. police, fire-fighters and paramedics), can be granted access into the building. Such data allowing automated response to a visitor can be stored locally by the remote device or by the server. The selected resident is able to specify whether the remote device or the server is allowed to automatically respond to a visitor and grant access into the building. This can for instance be achieved by an appropriate entry in the selected resident's calendar/agenda or contacts list stored by the remote device or by the server.

In a further embodiment of the method providing the access grant information comprises:

sending the access grant information to the mobile device;

providing the access grant information to the access control means either by the visitor, for instance manually or orally, or by means of the Mobile device, for instance wirelessly via NFC, Bluetooth (BLE) or WiFi, or acoustically via a loudspeaker of the mobile device, or optically via a screen/display of the mobile device.

In this way it is ensured that the visitor is present at the entrance in order to provide the access grant information to the access control means. This for example prevents the entrance from being unlocked or opened for someone other than the intended visitor.

Alternatively, the access grant information could also be provided directly to the access control means, with the disadvantage that it is not guaranteed that the actually intended visitor enters into the building once the entrance has been unlocked or opened.

In a further embodiment of the method establishing the link between the mobile device and the remote device comprises establishing a voice over IP (VOIP) link between the mobile device and the remote device, in particular an audio link and more particularly also a video link. This allows the selected resident to communicate with the visitor in at least the same way as when using a customary build-in intercom system without the need to install such a costly system.

In a further embodiment of the method establishing the link between the mobile device and the remote device comprises sending a message from the mobile device to the remote device via the server. The message received by the server from the mobile device is thereby forwarded to the remote device, i.e. the remote device is provided with a push message. Correspondingly, a response message may be sent from the remote device to the server, which then pushes the response message to the mobile device. In this way an instant messaging or chat function is provided allowing the visitor and the selected resident to exchange text messages. The advantage of employing such a push mechanism is that neither the originator nor the recipient requires to know e.g. a user name or other credentials of the other party.

In a further embodiment of the method establishing the link between the mobile device and the remote device is achieved at least partly via a mobile, cellular network, such as a Universal Mobile Telecommunications System (UMTS, 3G standard) or Long Term Evolution (LTE, 4G standard) network.

In a further embodiment of the method the mobile device of the visitor and the remote device of the selected resident are both mobile phones, in particular smartphones.

In this way communication can be established using equipment available to essentially all individuals today. No specialised equipment is necessary in order to achieve communication within the context of the proposed method for providing visitors controlled access into a building.

In a further embodiment of the method establishing the link between the mobile device and the remote device is controlled by the server, and in particular excludes providing contact information of the visitor and/or of the selected resident, such as a telephone number or a user name, explicitly to the visitor and/or the selected resident. In this way the exchange of personal information can be prevented, which for instance would not be the case if a standard voice call were used, where the call originator would for example require the cell phone number of the recipient.

In a further embodiment of the method the remote device is a device of a third pang other than the selected resident, e.g. a representative, such as an agent, a receptionist, a concierge, a call centre or a security or emergency service, in particular located at a different location than an office or an apartment of the selected resident. In this way it is possible for the selected resident to delegate providing access for the visitor into the building to a representative in case the selected resident is absent from the building or is occupied and cannot immediately deal with a visitor's request to access into the building.

In a further embodiment of the method the step of the server sending the list of residents is part of a building access support service, which comprises at least one of the following:

sending data and/or a script, such as HTML, JavaScript, CSS or Adobe Flash, to a client, in particular a thin client, such as a web browser, being executed by the mobile device as a web application;

providing a web link or web address such as a uniform resource locator (URL) to the mobile device, the web link allowing to access a web store server that makes available program code, in particular a native mobile application, more particularly a mobile client application;

downloading program code, in particular a native mobile application, more particularly a mobile client application, from the web store server to the mobile device, installing the program code in the mobile device, and executing the program code by the mobile device;

executing server-related program code, referred to as a cloud application, by the server, and providing an interface to the cloud application via a web browser being executed by the mobile device, wherein in particular only data entry is performed via the mobile device and data processing and storage is performed by the server.

In this way the proposed method for providing visitors controlled access into a building can be at least partly supported by an dedicated application ("device app") running on the mobile device or a web application ("web app") running in a web browser on the mobile device. Such an "device app" can for instance be downloaded from an online "app" store.

In a further embodiment of the method the data sent to the web browser of the mobile device and/or the downloaded program code is customised dependent on the information related to the visitor, in particular dependent on a user profile of the visitor. In this way the "web app" or the "device app" can be adapted to the individual preferences and specific requirements of the user/visitor.

In a further embodiment of the method further comprising authenticating the visitor by the mobile device, for instance by means of one of the following:

facial recognition based on a picture, taken by the camera of the mobile device;

voice recognition based on sound picked up by a microphone of the mobile device;

fingerprint scanning using a scanning unit of the mobile device;

entering a code such as a PIN code or a password into the mobile device;

providing answers to the mobile device to one or more questions.

In this way it is possible to positively validate the identity of the visitor by establishing that the visitor is authorised to access the mobile device which is associated with the visitor.

In a further aspect a mobile device application (dedicated "device app") is proposed, in particular a native mobile application, more particularly a mobile client application, comprising program code executable by a mobile device, the mobile device application being adapted to perform those steps of the proposed method for providing visitors controlled access into a building involving the mobile device. Such a dedicated "device app" allows to perform the proposed method efficiently and in particular taking into account the specific requirements and individual preferences of the user, e.g. by storing a user profile and user settings as well as by seamlessly integrating a plurality of services provided by the mobile device, e.g. audio/video calls, positioning, 3G/4G cellular, WLAN, Bluetooth, NFC, user identification, camera, microphone, code scanning, etc.

It is pointed out that combinations of the above-mentioned embodiments can yield even further, more specific embodiments according to the present invention.

The provision of "cloud-based" building access support services, could be made dependent on the user, i.e. the visitor, paying a fee to the provider of the cloud services. Fees could be based on the types of services being subscribed to and for instance the geographical area or the number of buildings to which the services apply. The fee could be paid when purchasing the "app" or recurringly as a subscription fee for services (to be) rendered during a subscription period.

BRIEF DESCRIPTION OF THE DRAWINGS

The present invention is further explained below by means of non-limiting specific embodiments and with reference to the accompanying drawing, which shows:

FIG. 1 a high-level block diagram of an exemplary setup for performing various embodiments of the method according to the present invention.

The numbers in square brackets present in FIG. 1 represent step sequence numbers indicating an exemplary order in which individual steps of a process are executed.

DETAILED DESCRIPTION OF EMBODIMENTS OF THE INVENTION

FIG. 1 illustrates a high-level block diagram of an exemplary setup for performing various embodiments of the method according to the present invention. A visitor 2 wanting to access a building 1, such as an office building with a plurality of different offices or an apartment building with a multitude of apartments, in which different residents work or live, will initially search for an entrance 4 to enter into the building 1. Typically, the visitor 2 will not be able to enter into the building 1, because for instance a door, gate or mechanical turnstile located at the entrance 4 prevents unauthorised access into the building. Alternatively, for example an optical turnstile is arranged at the entrance 4 and an acoustic or visual alarm is triggered if the visitor 2 enters into the building 1 without having received permission (i.e. authorisation) to do so.

In order to announce himself and to request permission to enter into the building 1 the visitor 2 will need to contact the resident 6 who he would like to visit, or someone else (i.e. a third party 11), such as a receptionist, a concierge or a front desk, who is authorised to provide the visitor 2 access into the building 1. To establish contact with the desired resident 6 (or third party 11) the visitor 2 uses a mobile device 3, such as his smartphone. When the visitor 2 is at or in close proximity of the entrance 4, his smartphone 2 that he is carrying with him will for instance receive a signal from a device 9 located at or in close proximity of the entrance 4 providing entrance identification information, e.g. an entrance ID (step [1] in FIG. 1). Such a device 9 can for instance be a short range radio beacon, e.g. a Bluetooth low energy (BLE) device, with a limited transmission range of e.g. 10 to 30 meters. The entrance ID can however can be provided in a number of other ways, e.g. by bringing the smartphone equipped with an near-field communication receiver (NFC) into contact with or immediate proximity of the device 9 correspondingly equipped with an NFC transmitter. Moreover, the entrance ID could also be broadcast via a wireless local area network (WLAN), e.g. in the form of its service set identifier (SSID), or it could be presented/displayed at entrance in the form of a visual code, e.g. a number, an alphanumeric string, a line or matrix barcode or a colour code. The number or text is then typed into the smartphone 3 or its camera is used to scan the barcode or colour code. If no entrance ID is explicitly provided at the entrance 4, position or location information derived by the smartphone 3 can be used to determine at which entrance the visitor 2 is situated.

The entrance ID, which is extracted from the received signal or detected from the code, or position information (e.g. geographic coordinates) is then transmitted by the smartphone 3 to a serve 5, e.g. via a mobile cellular network 10 (3G/4G, UMTS/LTE) to which the smartphone 3 is connected (step [2]). Alternatively, the smartphone 3 could also send this information via a WLAN located at the entrance 4, e.g. with coverage of a lobby area. The server 5 can be part of a cloud computing system providing a building access support service. In addition to the entrance ID the smartphone 3 can also transmit information related to the visitor, e.g. a (user) name, to the server 5 (step 2'). The server 5 may store user-specific information, such as a user profile of the visitor 2, which is associated with the received user name. A special, dedicated mobile application (i.e. an "app") may be executed by the smartphone 3 in order to support detecting the entrance ID and then sending it to the server 5 (as well as further steps of the proposed method). If no such app is installed on the visitor's smartphone 3, a web link, e.g. a URL, may be provided along with the entrance ID. The visitor 2 must then manually enter the web link into a browser of his smartphone 3 and subsequently enter the entrance ID on a web page, e.g. hosted by the server 5. Based on the entrance ID the server 5 can then determine exactly at which entrance 4 the visitor 2 is waiting. In a situation where there are a number of entrances spaced close together, and the smartphone 3 receives a plurality of entrance IDs, an exact position of the visitor 2 may for instance be determined based on an radio signal strength indicator (RSSI) for the various received signals.

The server 5 comprises a database with information regarding which residents live or work in the building 1 where the entrance 4 is located and sends a list of these residents to the visitor 2 (step [3]). This list is then displayed on the smartphone 3, e.g. via the browser or by the app. The visitor can then select which resident he would like to visit.

The information regarding the selected resident 6 is then used to establish a communication link between the visitor 2 and the selected resident 6 (step [4]-[4']). This may be achieved by sending the information regarding the selected resident 6 to the server 5, which then sets up the communication link between the visitor 2 and the selected resident 6, e.g. a voice over IP (VOIP) link providing both audio and video transmission. This has the advantage that the mobile phone numbers of the two parties (i.e. of the visitor 2 and the resident 6) do not need to be explicitly provided to either party. The selected resident 6 can for instance receive the visitor's call using his smartphone 7, which is also running a corresponding app. An appropriate app could however also be running on a computer or a tablet of the selected resident 6.

The selected resident 6 can then talk with the visitor 2 via the established audio link and possibly also see the visitor 2 via the optional video link. Instead of using such an audio/video link the visitor may alternatively (or additionally) communicate with the selected resident 6 (and vice versa) by means of an instant messaging or chat function provided by the app or via a web browser running on the smartphones 3, 7.

The selected resident 6 can then grant access to the visitor 2 into the building 1 by sending access grant information to a control access means 8 configured to e.g. lock or release the door, the gate or the mechanical or optical turnstile at the entrance 4 and let the visitor 2 pass. The access grant information can he sent to the control access means 8 directly (step [$5^1$]) or be provided to the visitor 2 so that he has to provide the access grant information to the control access means 8. The latter has the advantage that the visitor 2 must be physically present at the entrance 4 to provide the access grant information to the control access means 8. There are numerous options for providing the access grant information from the resident 7 to the visitor 2, e.g. via WLAN installed within the building 1 or via the mobile cellular network 10 and the server 5 (step [$5^3$]-[$5^4$]). The visitor 2 can then provide the access grant information to the control access means 8 directly (step [$5^5$]), e.g. by sending a code via BLE or NEC or by manually entering a code. Alternatively, the access grant information could be sent from the smartphone 3 via an intermediate device 9, e.g. a BLE device, which is for instance wired to the control access means 8 (step [$5^6$]-[$5^7$]).

In case the selected resident 6 cannot or does not want to be connected with the visitor 2 he can delegate receiving calls from visitors to a representative 11, such as a receptionist. This may for instance be the case in an office such as a law firm or a dental practice, where a receptionist 11 at the front desk takes all the calls from visitors and grants them access into the building 1. Information regarding whether a representative 11 is to be contacted when a visitor 2 is present wanting to see a specific resident 7 can be provided to the server 5 which then establishes an appropriate link. The access grant information is then provided by the representative 11 to the access control means 8 directly (step [$5^{1'}$]), or e.g. via the server 5 to the smartphone 3 (step [$5^{3'}$]-[$5^4$])), from which it is either provided directly to the access control means 8 (step [$5^5$]), or alternatively via the intermediate device 9 (step [$5^6$]-[$5^7$]).

It is also possible that either the selected resident's mobile device 7 or the representative's device 7' or even the server 5 (step [$5^2$]) automatically provides the access grant information to the access control means 8 dependent on information provided by the visitor 2, such as the visitor's function or task, for instance when he is an employee of a delivery service bringing or picking up a shipment. Information regarding a schedule or an appointment with a visitor 2 could also be stored in the calendar of the smartphone 7 of the resident 6 such that the building access support service app running of smartphone 7 could access this information and based thereupon grant access to the visitor 2 to which it relates at the appropriate time. Such information could also be provided to the representative's device 7' or to the server 5, so that these could automatically respond to the visitor 2 and grant assess based on such information from a schedule. Access can also be granted automatically based on the function of a visitor, e.g. for the personnel of security or emergency services.

As part of the proposed method the identity of the visitor can be positively verified by validating that the person using the visitor's mobile device 3 is authorised to do so, for instance by means built into the mobile device 3 for unlocking it, e.g. by fingerprint scanning, entering a code such as a PIN or facial recognition.

Moreover, it can be ensured that the visitor is sending current entrance ID information by making such information time-dependent, i.e. by changing it over time. Likewise, in order to ensure that the visitor is providing current access grant information this information may comprise expiration information. With this it can be guaranteed that the visitor 2 is currently located at the entrance 4 and not trying to trick the system using stored (i.e. old) entrance ID information or outdated access grant information.

The present invention proposes to replace the conventional procedure for gaining access into a building based on using fixtures in the form of nameplates and associated bell buttons at the entrance along with a fixedly wired intercom system for communication with the residents with the above described more advanced and highly flexible method centred around utilising a mobile device such as a smartphone that is ubiquitous nowadays and thus always available to every visitor. By providing a special, dedicated mobile application ("app") for mobile devices which supports in a seamless and simple manner all the functionalities required to perform the proposed method a configurable and in particular personalised building access support service can be provided in a very efficient and economical manner. The proposed method allows the incorporation of intelligent automatic access grant mechanisms which are not feasible using currently known systems and procedures. A high degree of flexibility and reduced cost is achieved by employing wireless technologies instead of rigid wire-based interconnections. Moreover, the proposed method is well-adapted to today's trend towards an increasingly mobile society where office workers and apartment residents are frequently changing their workplace and dwelling, requiring a system that can be rapidly updated to easily follow these changes and remain current.

What is claimed is:

1. A method for providing a visitor controlled access into a building, comprising the steps of:

providing entrance identification information to a mobile device of the visitor when the mobile device is in close proximity of an entrance of the building, the entrance identification information being uniquely associated with the entrance;

the mobile device sending the entrance identification information to a remote server;

the mobile device receiving a list of residents of the building from the server based on the entrance identification information;

the mobile device presenting the list of residents to the visitor;

the mobile device receiving an input from the visitor regarding a selection of a resident from the list of residents;

establishing a link between the mobile device and a remote device associated with the selected resident; and providing access grant information by the resident to the mobile device of the visitor to control access of the visitor into the building via the entrance.

2. The method of claim 1, wherein providing the entrance identification information comprises at least one of the following:

the entrance identification information being transmitted by a wireless short range communication device located in close proximity to the entrance;

the entrance identification information being transmitted by a near-field communication device located in close proximity to the entrance;

the entrance identification information being transmitted via at least one wireless local area network or a wireless peer-to-peer network located in close proximity to the entrance;

providing position information of the mobile device derived from a positioning system, or derived from information provided by at least one of mobile, cellular system and WLAN signals;

the entrance identification information being transmitted by an acoustic beacon;

the entrance identification information being provided by a visual code arranged, presented or displayed in close proximity to the entrance.

3. The method of claim 2, wherein providing the entrance identification information further comprises at least one of the following:

taking a picture with a camera of the mobile device;

picking up sound with a microphone of the mobile device;

entering at least one of text and numbers into the mobile device;

bringing the mobile device into at least one of contact with the near-field communication device and immediate proximity of the near-field communication device.

4. The method of claim 1, wherein at least one of the entrance identification information and the access grant information is time dependent.

5. The method of claim 1, further comprising sending information related to the visitor to the server.

6. The method of claim 1, wherein the access grant information is automatically provided based on data associated with the visitor.

7. The method of claim 1, wherein providing the access grant information comprises:

providing the access grant information to the access control means by at least one of the visitor and the mobile device.

8. The method of claim 1, wherein establishing the link between the mobile device and the remote device comprises establishing a voice over IP link between the mobile device and the remote device.

9. The method of claim 1, wherein establishing the link between the mobile device and the remote device comprises sending a message from the mobile device to the remote device via the server.

10. The method of claim 1, wherein establishing the link between the mobile device and the remote device is achieved at least partly via a mobile, cellular network.

11. The method of one of claim 1, wherein the mobile device of the visitor and the remote device of the selected resident are both mobile phones.

12. The method of claim 1, wherein establishing the link between the mobile device and the remote device is controlled by the server, and excludes providing contact information of at least one of the visitor and the selected resident explicitly to the visitor and/or the selected resident.

13. The method of claim 1, wherein the remote device is a device of a third party other than the selected resident.

14. The method of one of claim 1, wherein the step of the server sending the list of residents is part of a building access support service, which comprises at least one of the following:

sending data and/or a script to a client being executed by the mobile device as a web application;

providing at least one of a web link to the mobile device, the at least one of a web link and a web address providing access to a web store server that makes available program code;

downloading program code from the web store server to the mobile device, installing the program code in the mobile device, and executing the program code by the mobile device;

executing by the server, a cloud application comprising server-related program code, and providing an interface to the cloud application via a web browser being executed by the mobile device.

15. The method of claim 14, wherein at least one of the data sent to the web browser of the mobile device and/or the downloaded program code is customised dependent on the information related to the visitor.

16. The method of claim 1, further comprising authenticating the visitor by the mobile device by means of at least one of the following:

facial recognition based on a picture taken by the camera of the mobile device;

voice recognition based on sound picked up by a microphone of the mobile device;

fingerprint scanning using a scanning unit of the mobile device;

entering a code into the mobile device; and providing answers to the mobile device to one or more questions.

17. A non-transitory computer-readable medium encoded with a computer program when executed, performs the following steps:

providing entrance identification information to a mobile device of a visitor when the mobile device is in close proximity of an entrance of a building, the entrance identification information being uniquely associated with the entrance;

the mobile device sending the entrance identification information to a remote server;

the mobile device receiving a list of residents of the building from the server based on the entrance identification information;

the mobile device presenting the list of residents to the visitor;

the mobile device receiving an input from the visitor regarding a selection of a resident from the list of residents;

establishing a link between the mobile device and a remote device associated with the selected resident; and providing access grant information by the resident to an access control means adapted the mobile device of the visitor to control access of the visitor into the building via the entrance.

* * * * *